US006520867B1

(12) United States Patent
Miura et al.

(10) Patent No.: US 6,520,867 B1
(45) Date of Patent: Feb. 18, 2003

(54) GOLF CLUB SHAFT

(75) Inventors: Koryo Miura, Machida (JP); Kiyotaka Chaen, Osaka (JP)

(73) Assignee: Mizuno Corporation, Osaka (JP)

( * ) Notice: Subject to any disclaimer, the term of this patent is extended or adjusted under 35 U.S.C. 154(b) by 0 days.

(21) Appl. No.: 09/527,624

(22) Filed: Mar. 17, 2000

(51) Int. Cl.[7] ..... A63B 53/10; A63B 53/12
(52) U.S. Cl. ..... 473/316
(58) Field of Search ..... 473/316–323; 428/36.3, 36.9; 264/635; 156/187–188

(56) References Cited

U.S. PATENT DOCUMENTS 2,150,737 A * 3/1939 Chittick
2,250,428 A * 7/1941 Vickery
2,250,429 A * 7/1941 Vickery
4,106,777 A * 8/1978 Kim

* cited by examiner

*Primary Examiner*—Stephen Blau
(74) *Attorney, Agent, or Firm*—McDermott, Will & Emery

(57) ABSTRACT

The golf club shaft according to the present invention is provided with a pseudo-cylindrical concave polyhedral shell structure composed of triangles or trapezoids on the entire outer circumferential surface or on a part of the outer circumferential surface. With this structure of the golf club shaft, the degradation in the mechanical strength and the increase in the material cost are prevented. At the same time, a lighter weight golf club shaft can be produced while a greater degree of freedom is allowed in designing the characteristics such as bending stiffness distribution, a kick point position, bend point, etc. upon designing the golf club shaft.

12 Claims, 4 Drawing Sheets

GOLF CLUB SHAFT

BACKGROUND OF THE INVENTION

1. Field of the Invention

The present invention relates to a golf club shaft, and more specifically, to a structure of a golf club shaft which is lighter in weight and which allows a greater degree of freedom in areas of kick point design, bend point, and weight distribution.

2. Description of the Background Art

In order to realize lighter weight for a golf club shaft, either a material having a lighter specific gravity must be employed for the shaft or the shaft must be formed with less material when using a material having the same specific gravity as that conventionally used.

The material for the golf club shaft is selected based on such considerations as strength, modulus of elasticity, cost, possibility for mass production, etc. The known examples of shafts for golf clubs conventionally commercially available include a steel shaft utilizing an iron-based material such as carbon steel and steel alloy, a metal shaft utilizing a metal other than iron-based metals, such as titanium and titanium alloy, and a fiber reinforced plastic shaft (hereinafter referred to as an FRP shaft) using mainly epoxy resin as a matrix and reinforced by fibers such as carbon fibers and glass fibers serving as a reinforcing material.

With a metal shaft, there is a limit to achieving lighter weight since the specific weight of the material used for a metal shaft is generally heavier than that of the material used for an FRP shaft. As a consequence, the recent trends show an increase in the percentage of FRP shafts used: for instance, almost all of the wood clubs has come to employ FRP shafts, and no less than 80% of iron clubs has come to utilize FRP shafts.

The performance of a golf club shaft is evaluated with respect to kick point, bend point, mechanical strength, etc. Here, the term "kick point" refers to the position at which the shaft bends most flexibly. The term "bend point" signifies the characteristic categorized by the bending state of the shaft at a swing, such as being bent flexibly relatively easily in the region in the vicinity of the tip portion of the shaft, as being bent flexibly relatively easily in the region of the shaft near the grip of the club, and as being of the intermediate bending state of the former two cases.

In most cases, the metal shaft is formed of a single material so that the material has a uniform modulus of elasticity, causing the performance of the shaft in areas of kick point, bend point, strength, etc. to be substantially determined by the outer diameter distribution and the thickness distribution in the lengthwise direction of the shaft. On the other hand, the FRP shaft encompasses countless possible choices of strengths of reinforcement fibers, degrees of elasticity, etc., and by suitably combining these choices, the performance of the shaft such as its bend point, strength, etc. can be changed while the outer diameter distribution and the thickness distribution in the lengthwise direction of the shaft remain the same.

The weight of the entire shaft, however, can only be lightened by reducing the amount of material used. Under the circumstance, the improvement of shaft performance such as its strength and bend point involves great difficulties.

Particularly, for the lightweight shaft having an overall weight of about 30 to 40 grams, ensuring the necessary strength is the best that can be done, leaving little room for the consideration of shaft performance such as bend point.

Consequently, there has been a need for a design or a manufacturing method which ensures the necessary strength while achieving lighter weight and which further allows some degrees of freedom in areas of shaft performance, such as bend point.

As described above, a metal shaft has already reached its limits with regard to achieving light weight due to the uniformity of its material. Moreover, with an FRP shaft, it has been the case, when the shaft is a lightweight shaft of about 30 grams to 40 grams as described above, that ensuring at least the required strength for the shaft is the best that can be done, and not enough degree of freedom of design is allowed to realize a special bend point or kick point.

One approach in designing the bend point, the kick point, and the like concerns "bending stiffness" (EI). Here, E is the Young's modulus (modulus of elasticity), which is dependent upon the solid state properties of the material forming the shaft. I is the geometrical moment of inertia, which is proportionate to the biquadrate of the outer diameter of the shaft. Bending stiffness is a product of these two elements, E and I.

Based on the approach described above, a technique of achieving lighter weight while changing the bend point and the kick point by employing a reinforcing fiber of high elasticity for the FRP shaft to increase the value of E is contemplated. A high elasticity fiber, however, is quite expensive, and, despite its high cost, only little effect can be expected of the high elasticity fiber to change EI. This is due to the fact that, while I is proportionate to the biquadrate of the outer diameter, an increase in E is only reflected as an increase in the modulus of elasticity proportionate to the value of E.

Since I is proportionate to the biquadrate of the outer diameter, it is not altogether impossible to change the performance in the areas of bend point, kick point, etc. with extreme outer diameter distribution and the thickness distribution. In order to maintain the strength of the shaft, however, portions designed with extreme outer diameter distribution and the thickness distribution must be reinforced, resulting in the increase in the overall weight of the shaft.

Under such circumstance as described above, there was no solution but to wait for the development of a new inexpensive material or fiber of high strength or to develop a novel measure to improve the structure and the manufacturing method in order to achieve lighter weight as well as satisfactory performance in the areas of bend point, kick point, and the like.

SUMMARY OF THE INVENTION

In view of the above problem of prior art, the main object of the present invention is to provide a golf club shaft which is designed to be lighter in weight without reducing the mechanical strength yet reducing the material cost, while allowing a greater degree of freedom in designing the characteristics such as bending stiffness distribution, a kick point position, bend point, etc.

The golf club shaft according to the present invention that achieves the above objective is provided with a PCCP (Pseudo-Cylindrical Concave Polyhedral shell) structure on its outer circumferential surface. According to the present invention, the PCCP structure may be either provided on the entire outer circumferential surface of a golf club shaft, or provided only partially on the outer circumferential surface. When the PCCP structure is provided on the entire outer circumferential surface, it may be provided not only in one location but in multiple locations.

In one embodiment of the golf club shaft according to the present invention, the PCCP structure is provided at least in a portion within the range of 150 mm to 400 mm from a grip end of the shaft and/or at least in a portion within the range of 0 mm to 350 mm from a neck upper end of the shaft. Such provision of the PCCP structure can form a kick point in the vicinity of the grip end of the shaft and/or a kick point in the vicinity of the tip portion of the shaft.

A kick point can also be formed by changing the size of a component of the PCCP structure such that the pitch of the component becomes gradually longer toward the left and right directions away from the kick point.

The PCCP structure applied to the present invention, for instance, forms a cylindrical body in which a crease line is formed by a base common to a pair of triangles arranged in a diamond shape, where one triangle has its base contacting a base of the other triangle, and in which a fold line is formed by an oblique side in one case, or forms a cylindrical body in which a crease line is formed by a lower base common to a pair of trapezoids forming a hexagonal shape, where one trapezoid has its lower base contacting a lower base of the other trapezoid, and in which fold lines are formed by an upper base and an oblique side in another case. In such a PCCP structure, the top portions of the crease line and the fold line are formed, for instance, as obtuse angles or in arc-like shapes.

According to the structure of the golf club shaft of the present invention described above, by suitably selecting the location to which the PCCP structure is provided or the arrangement pitch of the component of the PCCP structure, a greater degree of freedom is allowed in designing the characteristics such as a kick point position in the shaft, bending stiffness distribution, bend point of the shaft, etc. without degrading the mechanical strength or increasing the material cost.

More specifically, in comparison with the conventional shaft without the PCCP structure, the shaft provided with the PCCP structure can be made thinner and lighter in weight while achieving the same strength. In addition, when formed in the same thickness, the shaft provided with the PCCP structure achieves a greater strength.

From the viewpoint of the material, the shaft provided with the PCCP structure can utilize a less expensive material of a lower strength for the same thickness when compared with a conventional shaft without the PCCP structure. Moreover, an expensive high elasticity material is not required in changing the bending stiffness (EI) distribution. Consequently, the material cost for the shaft can be reduced.

Further, the PCCP structure can be provided to form a kick point in a desired portion without changing the outer diameter or the thickness distribution. In addition, designing of a shaft with bending stiffness distribution that changes radically, which was not possible with the usual design techniques, is made possible.

Furthermore, the PCCP structure may be employed to produce shafts of original patterns and unique designs, which would appeal strongly to the consumers, arousing their willingness to purchase the products, thereby advantageously leading to the increase in the quantity of production.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

The golf club shaft according to the present invention has the so-called PCC structure provided on the outer surface.

Figure 6:
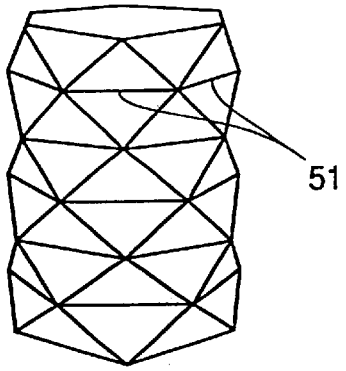
FIG. 6 is a perspective view of a cylindrical body provided with a PCCP structure.

FIG. 6 is a diagram of a cylindrical body provided with a PCCP structure, and FIGS. 7A to 7D are diagrams showing the development plans of cylindrical bodies each having a PCCP structure.

As shown in FIG. 6, the macroscopic form of the PCCP structure resembles a cylindrical body. The actual PCCP structure is formed by arranging triangles where a pair of triangles is disposed with one triangle having its base contacting the base of the other triangle and thus forming a diamond shape (see FIG. 6) or by arranging trapezoids where a pair of trapezoids is disposed with one trapezoid having its lower base contacting the lower base of the other trapezoid and thus forming a hexagonal shape.

Figure 7A:
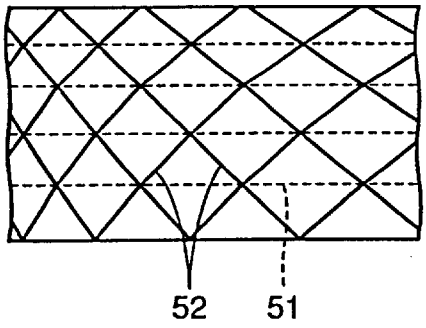
FIGS. 7A to 7D are development plans of cylindrical bodies each provided with a PCCP structure.
Figure 7B:
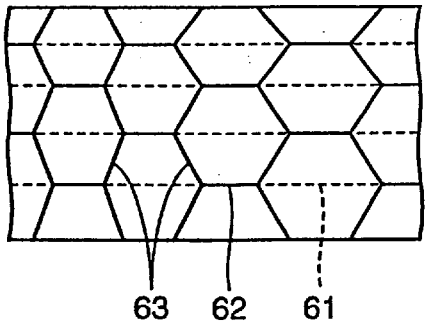
Figure 7C:
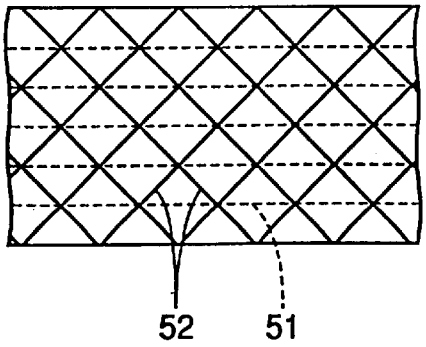

In FIGS. 7A to 7D, the solid lines excluding the lines outlining the perimeter represent "fold lines" and the dashed lines represent the "crease lines." In the PCCP structure composed of triangles, base 51 common to a pair of triangles arranged in a diamond shape becomes the crease line, while oblique sides 52 of the triangles become the fold lines, thus forming a cylindrical body, as shown in FIG. 7A or FIG. 7C.

Figure 7D:
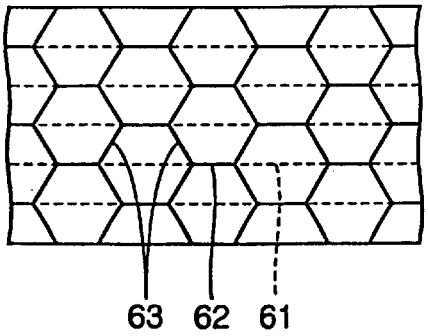
Figure 8:
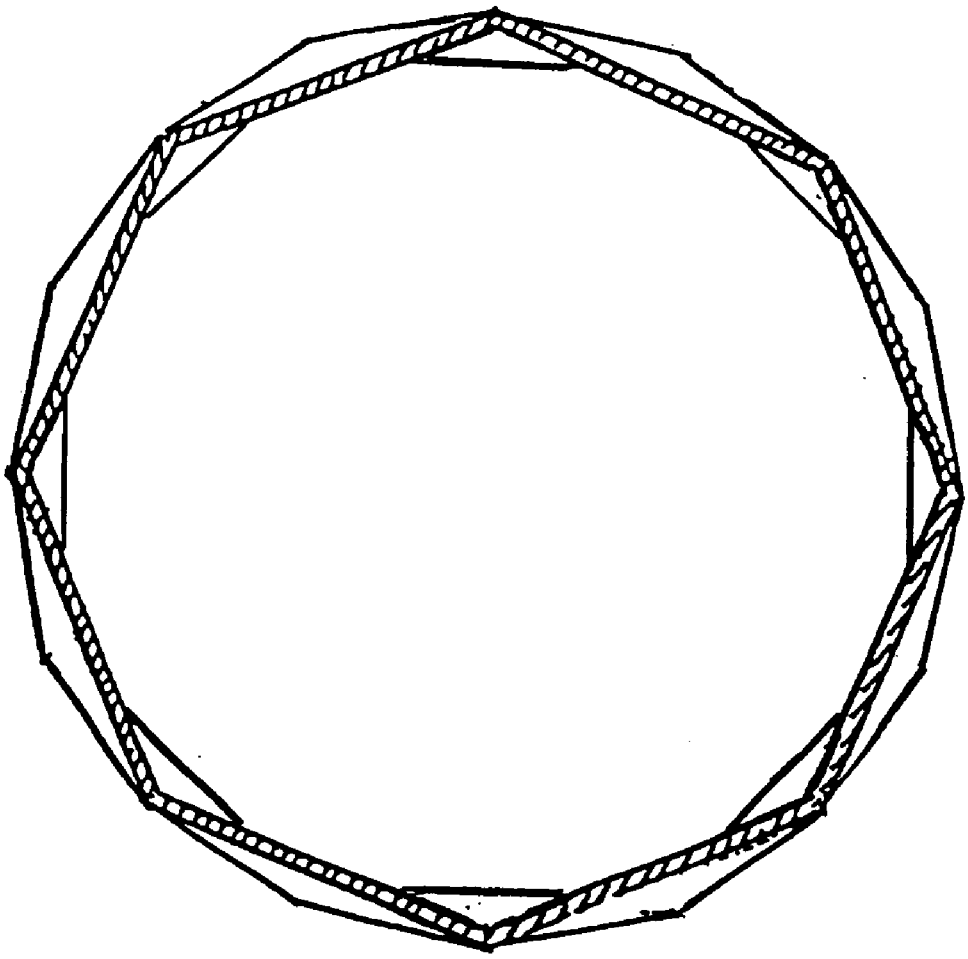
FIG. 8 illustrates a cross-sectional view of one exemplary embodiment of the shaft of the present invention across section VIII—VIII in FIG. 1.

In the PCCP structure composed of trapezoids, lower base 61 common to a pair of trapezoids forming a hexagonal shape where one trapezoid has its lower base 61 contacting the lower base 61 of the other trapezoid becomes a crease line, while an upper base 62 and oblique sides 63 of the trapezoids become the fold lines, thus forming a cylindrical body, as shown in FIG. 7B or FIG. 7D.

Moreover, while the top portions of the fold lines and the crease lines form obtuse angles in FIGS. 7A to 7D, these portions can be formed in arc-like shapes.

The PCCP structure is simply formed from triangles or trapezoids, and a curved surface of a desired curvature can be formed by changing the length of each side of the triangles or the trapezoids, as shown in FIG. 7A or FIG. 7B. Therefore, it is easy to implement the PCCP structure to a basically elongated cylindrical body, and the PCCP structure can be provided in a desired manner to a surface of the shaft formed with a portion having a step or a taper, and a straight portion by changing the length of each side of the triangles or the trapezoids. Thus, the PCCP structure can be provided to the entire golf club shaft, or in a portion of the golf club shaft, or in multiple locations as desired.

The cylindrical body formed by the PCCP structure is characterized by higher stiffness and greater strength toward the central axis of the cylindrical body when compared with a cylindrical body of the same thickness yet having a smooth curved surface. Thus, the cylindrical body can be designed with a small thickness without reducing the strength, in the direction toward the center, of the golf club shaft having a hollow portion.

Such facts are confirmed by the data given in Table 1 below.

TABLE 1

| | Tube weight (g) | Thickness (mm) | Yield point to compression in direction of circumference (kgf) | Vibration frequency in direction of height (Hz) |
|---|---|---|---|---|
| Normal cylindrical tube | 35.3 | 0.22 | 5.0 | 1396 |
| Tube with PCCP structure | 26.0 | 0.17 | 5.0 | 1247 |

Table 1 compares a normal cylindrical body formed in a conventional manner with a cylindrical body formed with the PCCP structure, each formed as a cylindrical tube with a 52 mm diameter and a height of 104 mm.

The cylindrical tube with the PCCP structure used in this experiment is shaped as shown in FIG. 6, where the PCCP structure is composed of isosceles triangles each of the same shape with a base of 14.85 mm and an oblique side of 10.5 mm. The size of the isosceles triangles composing the PCCP structure and the number of the isosceles triangles disposed in the direction of the circumference, however, are not the same as the cylindrical body shown in FIG. 6.

Table 1 shows that, when the yield point to compression in the direction of the circumference (that is, the point at which the cylindrical body begins to deform under the increased load in the direction of the circumference) is set at 5 kgf for both cylindrical tube, a normal cylindrical tube required the thickness of 0.22 mm while the cylindrical tube formed with the PCCP structure only required the thickness of 0.17 mm.

Since the overall weight of the normal cylindrical tube is 35.3 g while the overall weight of the tube with PCCP structure is 26.0 g, the overall weight of the cylindrical body can be reduced by approximately 26% by providing the PCCP structure.

Now, specific embodiments of the present invention will be described below.

First Embodiment

Figure 1:
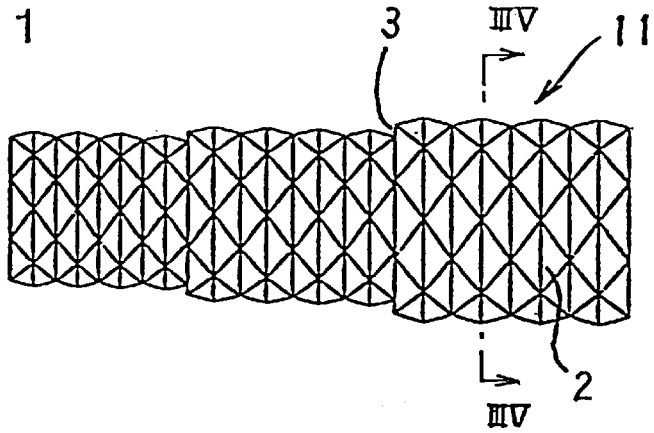
FIG. 1 is a schematic diagram showing, with modification for simplicity, a portion of a golf club shaft according to a first embodiment of the present invention which is a steel shaft having steps and provided with a PCCP structure across its entire length.

FIG. 1 is a schematic diagram showing a portion of a golf club shaft according to the first embodiment of the present invention, which is a steel shaft 11 having a step 3 and provided with a PCCP structure 2 across its entire length. This type of a golf club shaft has different outer diameters of the cylindrical body in the portion toward the grip (generally referred to as the "butt end") and in the portion toward the head (generally referred to as the "tip end"). Normally, small steps 3 of about 20 are repeated to effect the gradual change in the outer diameter.

In the embodiment shown in FIG. 1, isosceles triangles composing PCCP structure 2 are disposed such that the number of isosceles triangles in the direction of the outer circumference is n at any given location in the longitudinal direction of the shaft. At the same time, PCCP structure 2 is provided across the entire length of the shaft. Therefore, the isosceles triangles composing PCCP structure 2 become smaller toward the tip end. It is to allow the entire shaft to bend flexibly in a uniform manner that the isosceles triangles composing PCCP structure 2 are disposed in the above described manner.

Second Embodiment

Figure 2:
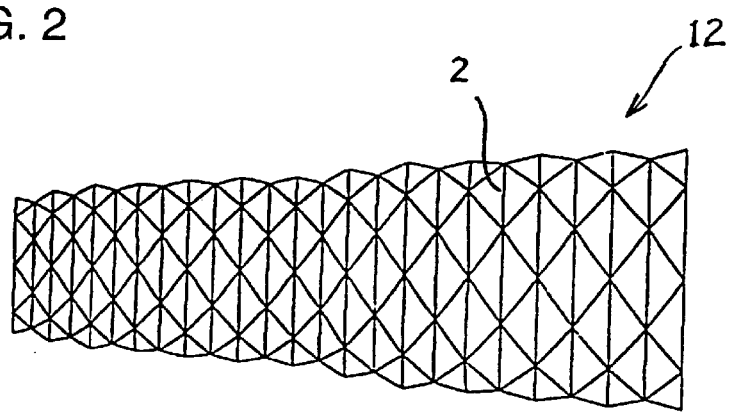
FIG. 2 is a schematic diagram showing, with modification for simplicity, a portion of a golf club shaft according to a second embodiment of the present invention which is an FRP shaft provided with a PCCP structure across its entire length.

Now, the second embodiment will be described in relation to FIG. 2. FIG. 2 shows a portion of an embodiment of an FRP shaft 12 provided with a PCCP structure across its entire length.

In general, the outer diameter of FRP shaft 12 changes as FRP shaft 12 tapers from the butt end toward the tip end. When providing PCCP structure 2 to the outer circumference of the tapering shaft, the length of the base of each triangle must be continuously changed according to the outer diameter so that the same number of triangles composing PCCP structure 2, i.e., n triangles, would be disposed at any given location in the longitudinal direction of the shaft. In other words, when the same number ("n") of triangles are disposed in the direction of the outer circumference at any given location, the base of each triangle necessarily becomes smaller as the outer diameter gets smaller. Moreover, it is to allow the entire shaft to bend flexibly in a uniform manner that the same number ("n") of triangles are disposed in the direction of the outer circumference at any given location from the butt end to the tip end.

Third Embodiment

Figure 3:
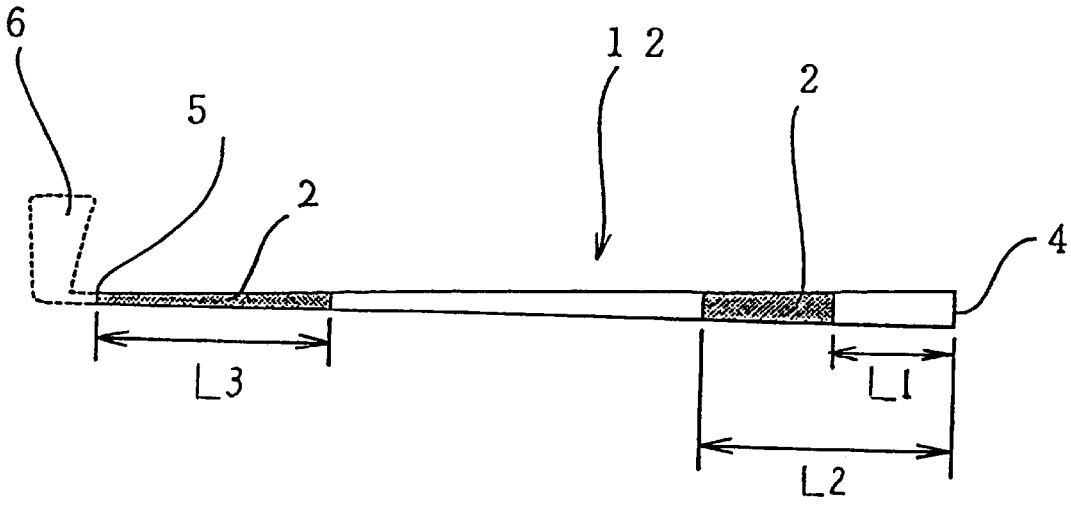
FIG. 3 is a diagram showing a golf club shaft according to a third embodiment of the present invention which is an FRP shaft partially provided with PCCP structures in two locations.

Now, the third embodiment will be described in relation to FIG. 3. FIG. 3 shows an embodiment of FRP shaft 12 partially provided with PCCP structures 2 in two locations. The same arrangement of the triangles of PCCP structures 2 in the above first or second embodiment can be employed in this embodiment.

The cylindrical body provided with the PCCP structure has a higher strength against compression in the direction toward the central axis of the cylindrical body. On the other hand, in the PCCP structure composed of triangles, the stiffness is lowered in the direction perpendicular to the base of a triangle (or in the direction perpendicular to the upper base and the lower base in the case of the PCCP structure composed of trapezoids as shown in FIG. 7B or FIG. 7D).

More specifically, in the case of the tube with PCCP structure composed of triangles as shown in FIG. 7 which was used in the experiment that produced the numerical values shown in Table 1, the stiffness becomes lower the direction perpendicular to bases 51 that are continuous in the direction of the circumference, i.e. the direction of the height of the tube (or in the longitudinal direction, when applied to a golf club shaft). This is also seen from the fact that, in Table 1, the "vibration frequency in direction of height" of the tube with the PCCP structure is lower than that of the normal cylindrical tube.

As a consequence of the stiffness in the longitudinal direction of the portion provided with PCCP structure 2 being lowered, the stiffness in the bending direction of the portion is lowered as well, permitting that portion to bend more flexibly than other portions. In other words, a kick point can be formed in the portion provided with PCCP structure 2 without changing the outer diameter or the thickness distribution.

In the golf club shown in FIG. 3, PCCP structure 2 is provided in the following two locations: one in a portion within the range of 150 mm (L1 in FIG. 3) to 400 mm (L2 in FIG. 3) from a grip end 4 of the shaft and another in a portion within the range of 0 mm to 350 mm (L3 in FIG. 3) from a neck upper end 5 of the golf club. Thus, the shaft would be formed with kick points in the two locations of the grip end side and the neck end side.

PCCP structure 2 can be provided entirely to the regions within the range of 150 mm to 400 mm from grip end 4 of the shaft and within the range of 0 mm to 350 mm from neck upper end 5, or it can be provided to a portion of these regions. Moreover, PCCP structure 2 can be provided to multiple locations within these regions. By disposing PCCP structure 2 in these positions, the shaft can be made to bend flexibly in its best suited locations. As a result, the head speed can be improved, while at the same time the projecting angle of the ball can be enlarged, which leads to the increase in the flight distance of the ball.

Provision of PCCP structure 2 in the range of 150 mm to 400 mm from grip end 4 of the shaft produces a golf club shaft with a bend point that allows the portion of the shaft near the grip of the club to bend flexibly relatively easily, which contributes to the increase in the head speed. In addition, provision of PCCP structure 2 in the range of 0 mm to 350 mm from neck upper end 5 of the shaft produces a golf club shaft with a bend point that allows the portion in the vicinity of the tip portion of the shaft to bend flexibly relatively easily, which contributes to the increase in the head speed as well as to the enlargement of the projecting angle of the ball.

Furthermore, the size of the isosceles triangles composing the PCCP structure provided to a golf club shaft can be changed to effect the desired bend point or to form a desirable kick point.

Fourth Embodiment

Now, the fourth embodiment will be described in relation to FIGS. 4A to 4C. In the fourth embodiment, three models shown in FIGS. 4A to 4C are employed to investigate the changes in the shaft strength when the size of the isosceles triangles composing the PCCP structure is changed upon providing the PCCP structure to a golf club shaft.

Figure 4A:
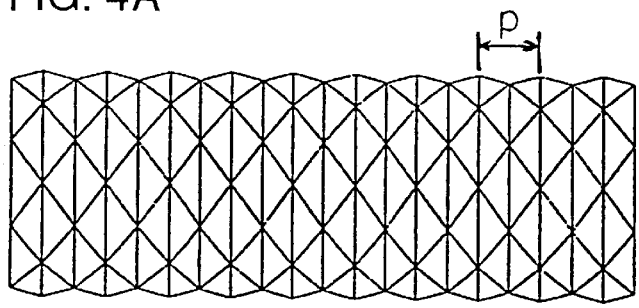
FIGS. 4A to 4C are diagrams illustrating three models employed to investigate the changes in the shaft strength when the size of the isosceles triangles serving as components of a PCCP structure is changed upon providing such a PCCP structure to a golf club shaft.
Figure 4B:
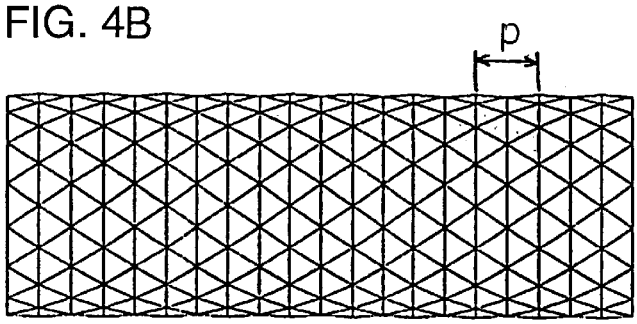
Figure 4C:
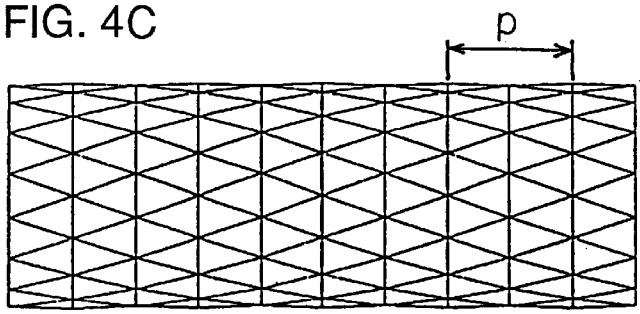

The model shown in FIG. 4A is provided with eight isosceles triangles in the direction of the circumference, and has its pitch "p" set at 10 mm. Pitch "p" is the distance, in the longitudinal direction of the shaft, between the vertex of one isosceles triangle and the vertex of the other isosceles triangle of a pair of isosceles triangles adjacent to one another and sharing a common base. The model shown in FIG. 4B has the same pitch "p" as the model shown in FIG. 4A, but is provided with sixteen isosceles triangles, which is twice as many triangles as provided for the FIG. 4A model, in the direction of the circumference. The model shown in FIG. 4C is provided with the same number of isosceles triangles as in FIG. 4A model, i. e., eight, in the direction of the circumference, while pitch "p" is set at 20 mm, which is twice as long as the pitch in FIG. 4A model.

The numerical values representing the amount of deformation that is produced when the compression load of 10 kg is applied in the longitudinal direction of each of these models are shown in Table 2 below.

TABLE 2

| Model | Pitch (mm) | Number of division in direction of circumference | Amount of deformation in longitudinal direction (mm) |
|---|---|---|---|
| FIG. 4A | 10 | 8 | 7.85E-04 |
| FIG. 4B | 10 | 16 | 3.95E-04 |
| FIG. 4C | 20 | 8 | 5.46E-04 |

In Table 2, the smaller the numerical value of the amount of deformation in the longitudinal direction is, the greater the stiffness becomes in the longitudinal direction. Conversely, the larger the numerical value of the amount of deformation in the longitudinal direction is, the lower the stiffness becomes in the longitudinal direction. Therefore, the model having a smaller value of the amount of deformation in the longitudinal direction may bend less flexibly, while the model having a greater value may bend more flexibly.

The comparison in the numerical values of the FIG. 4A model and the FIG. 4B model in Table 2 shows that the shaft provided with PCCP structure composed of a greater number of isosceles triangles in the direction of the circumference would bend less flexibly. In addition, the comparison between the FIG. 4A model and the FIG. 4C model shows that a longer pitch produces a less flexibly bent shaft.

Thus, in a golf club shaft provided with the PCCP structure across its entire length, a kick point can be formed by changing the size of the isosceles triangles composing the structure, either by making the pitch shorter or by decreasing the number of division in the direction of the circumference.

In practice, since the isosceles triangles composing the PCCP structure are continuously provided, it is difficult, from the viewpoint of design, to change the number of division in the direction of the circumference in the middle of the continuous pattern. Therefore, it is easier to shorten the pitch while the number of division in the direction of the circumference is left unchanged.

Fifth Embodiment

Now, the fifth embodiment will be described in relation to FIG. 5. The fifth embodiment illustrates an example of a way to provide the PCCP structure so as to form a kick point.

Figure 5:
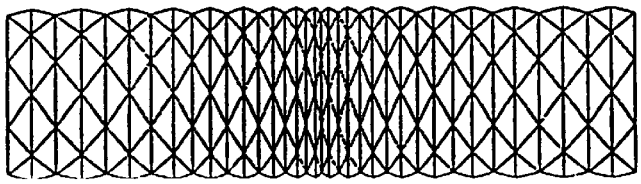
FIG. 5 is a schematic diagram illustrating an example of a way to provide a PCCP structure so as to form a kick point.

In order to form a kick point by provision of the PCCP structure, the isosceles triangles composing the PCCP structure can be changed in size such that the pitch of the isosceles triangles becomes longer toward the left and the right directions away from the location to be the kick point, as shown in FIG. 5. Moreover, although not shown in the Figure, the isosceles triangles in the vicinity of the location in which kick point is formed may be designed to have a uniform pitch that is smaller than that in other portions.

As can be seen from the descriptions concerning the above third and fifth embodiments, in order to form a kick point by provision of the PCCP structure, isosceles triangles of uniform size may compose the PCCP structure, as in the case of the golf club shaft shown in FIG. 3 where the PCCP structure is only partially provided, or the isosceles triangles may be changed in size such that the pitch of the isosceles triangles becomes longer toward the left and the right directions away from the location to be the kick point, as shown in FIG. 5.

Further, the same effects can be observed in the above embodiments when employing trapezoids in place of the isosceles triangles as components of the PCCP structure.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A golf club shaft provided with a pseudo-cylindrical concave polyhedral shell structure on an outer circumferential surface, wherein a component of said pseudo-cylindrical concave polyhedral shell structure is changed in size such that a pitch of said component becomes longer in a continuous manner toward left and right directions away from a kick point.

2. The golf club shaft according to claim 1, wherein said pseudo-cylindrical concave polyhedral shell structure forms a cylindrical body in which a crease line is formed by a base common to a pair of triangles arranged in a diamond shape, where one triangle has its base contacting a base of an other triangle, and in which a fold line is formed by an oblique side.

3. The golf club shaft according to claim 1, wherein said pseudo-cylindrical concave polyhedral shell structure forms a cylindrical body in which a crease line is formed by a lower base common to a pair of trapezoids forming a hexagonal shape, where one trapezoid has its lower base contacting a lower base of an other trapezoid, and in which fold lines are formed by an upper base and an oblique side.

4. The golf club shaft according to claim 3, wherein top portions of said crease line and said fold lines of said pseudo-cylindrical concave polyhedral shell structure are formed as obtuse angles or in arc-like shapes.

5. A golf club shaft provided with a pseudo-cylindrical concave polyhedral shell structure in a position where a kick point is formed on an outer circumferential surface with each polyhedral being concave.

6. The golf club shaft according to claim 5, wherein said shell structure includes a polygon cross-section, at least three internal adjacent angles fined by lines of said polygon cross-section are less than 180°.

7. The golf club shaft according to claim 5, wherein said shell structure is configured to provide a decreased bending stiffness relative to other portions of said golf club shaft.

8. The golf club shaft according to claim 7, wherein said shell structure provides said decreased bending stiffness without decreasing the diameter thereof.

9. A golf club shaft provided with a pseudo-cylindrical concave polyhedral shell structure in a plurality of positions where kick points are formed respectively on an outer circumferential surface with each polyhedral being concave.

10. The golf club shaft according to claim 9, wherein said shell structure includes a polygon cross-section, at least three internal adjacent angles formed by lines of said polygon cross-section are less than 180°.

11. The golf club shaft according to claim 9, wherein said shell structure is configured to provide a decreased bending stiffness relative to other portions of said golf club shaft.

12. The golf club shaft according to claim 11, wherein said shell structure provides the decreased bending stiffness without decreasing the diameter thereof.

* * * * *